United States Patent [19]

Hampton

[11] Patent Number: 4,789,348

[45] Date of Patent: Dec. 6, 1988

[54] MODULAR CONNECTOR WITH UNITARY DUST COVER

[75] Inventor: Clifton G. Hampton, Bedford, Tex.

[73] Assignee: Siecor Corporation, Hickory, N.C.

[21] Appl. No.: 102,590

[22] Filed: Sep. 30, 1987

[51] Int. Cl.[4] ..... H01R 13/44

[52] U.S. Cl. ..... 439/142; 439/596

[58] Field of Search ..... 439/135, 142–145, 439/596, 812

[56] References Cited

U.S. PATENT DOCUMENTS 4,607,900 8/1986 Andrews et al. ..... 439/142

4,660,914 4/1987 Nakamura ..... 439/596

*Primary Examiner*—Gil Weidenfeld

*Assistant Examiner*—Paula Austin

*Attorney, Agent, or Firm*—J. David Abernethy

[57] ABSTRACT

A connector having a unitary dust cover. The dust cover is formed by a cap fitting on one side of the connector and two flaps attached to the cap, each flap adapted to cover a portion of the other side of the connector, which may have attached posts to allow the connector to be used in modular fashion with a base plate. At least one flap may be held between the posts by indentations in the flap.

6 Claims, 2 Drawing Sheets

FIG. 3
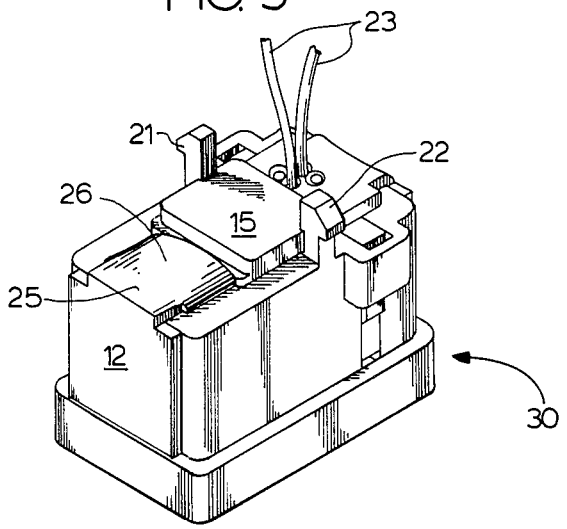
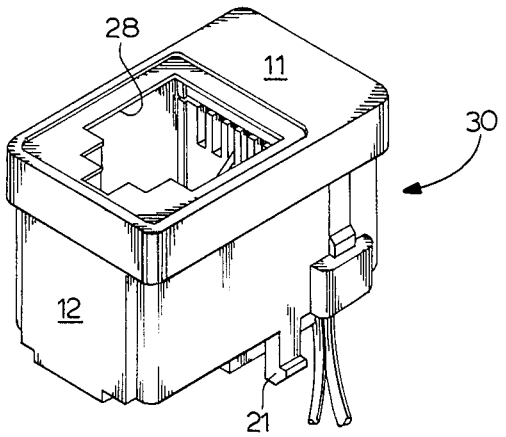
FIG. 4

MODULAR CONNECTOR WITH UNITARY DUST COVER

BACKGROUND OF THE INVENTION

1. Field of the Invention:

The invention pertains to connectors, particularly communication connectors such as electrical jacks and dust covers therefor.

2. Description of the Related Art:

A previously-used means for preventing the entry of dust into an electrical jack uses two separate dust covers, one dust cover being a cap placed on one end of the jack and the other dust cover being a cap placed on the other end of the jack. The dust cover cap facing the jack opening has a hole therein through which the jack plug fits. The other cap has perforations allowing wires to enter the other side of the jack.

SUMMARY OF THE INVENTION

Modern manufacturing techniques for many electrical devices call for modular units; the communications connector has one or more posts which are designed to snap in or out of a baseboard, which itself may be modular in nature. These posts, in turn, may have projecting tips which hold the posts in place on the baseboard. While it would be desirable to have dust cover protection for such a modular unit, the posts on which the connector is snapped into the baseboard creates a problem for the two-cap dust cover described above; one of the caps would have to have holes large enough to be penetrated by the projecting tips of the posts, so the practitioner would have to either make the resulting cap holes larger than the base of the post, in which case an entry for dust is created, or make the cap holes of a tight rubber or other elastomer which can be penetrated by the tips of the post and then contract to fit snugly around the base portion of the post. If the latter option were followed, it would then be somewhat annoying to remove the second dust cover cap, whereas the "modular" philosophy demands that access be as quick and easy as possible. Furthermore, the use of two caps calls for two separate manufacturing processes, and dictates that two caps must be present for every connector, increasing the possibility of misplacing the rather small caps. By being wrapped around the connector and trapped in position when the connector is snapped into a baseboard, the unitary cover is more positively secured to the connector than two separate dust covers, thus preventing accidental removal and loss. Therefore, the object of the present invention is to provide a dust cover arrangement which is more suitable for a modular unit than the two-cap dust cover.

BRIEF EXPLANATION OF THE DRAWINGS

FIG. 3 is a back view of the assembled jack and dust cover; and

FIG. 4 is a front view of the assembled jack and dust cover.

DETAILED DESCRIPTION OF THE PREFERRED EMBODIMENT

Figure 1:
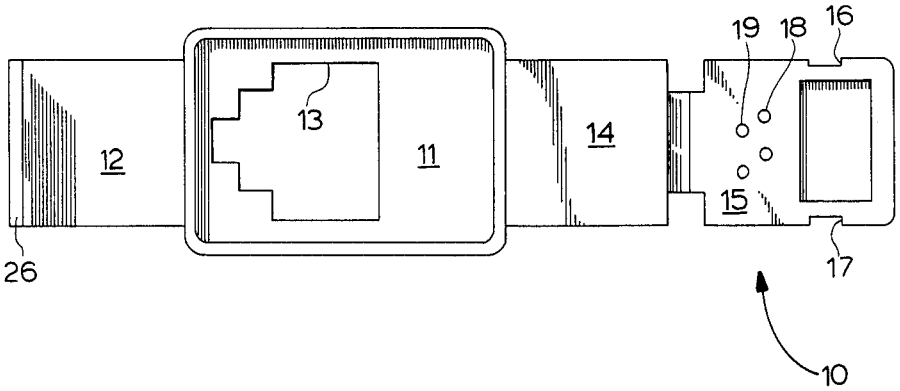
FIG. 1 is a plan view of a dust cover.

FIG. 1 shows dust cover 10, which has cap portion 11 having hole 13. Attached to either side of cap 11 are the first flap, comprising members 14 and 15, and the second flap, comprising members 12, 25, and 26. The first flap contains indentations 16, 17 and perforations 18, 19.

Figure 2:
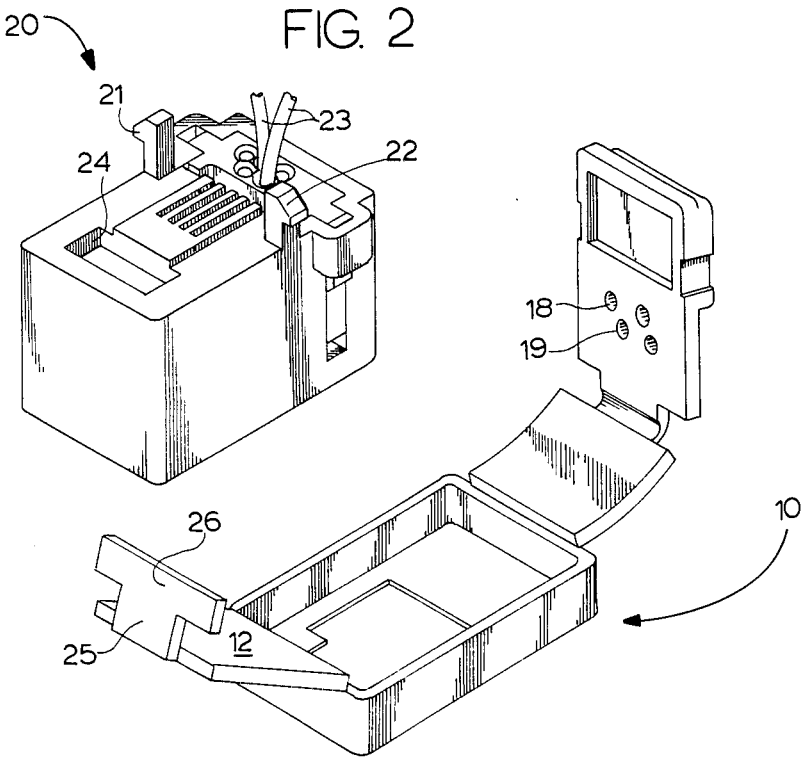
FIG. 2 is a perspective view of an electrical jack and a flexed dust cover.

FIG. 2 shows dust cover 10 in proximity to connector 20, an electrical jack. Jack 20 has posts 21, 22 mounted on its second side. Also on the second side of jack 20 are wires 23 and second opening 24. FIG. 2 further shows dust cover 10, which may be conveniently made of an elastomer such as rubber, it is constructed as shown to easily fold over jack 20.

FIG. 3 shows element 30, dust cover 10 placed on jack 20. Wires 23 fit through perforations such as 18, 19, in portion 15 of the first flap. Indentation 16 of first flap 15 now abuts post 21, and indentation 17 of first flap portion 15 abuts post 22, thus serving to hold the first flap in place. Tab portion 26 of the second flap fits within second opening 24 to keep the second flap in place. FIG. 4 shows a front view of assembly 30, where hole 13 of cap 11 is in communication with first opening 28 in the first side of jack 20. When a jack plug, not shown, is inserted into first opening 28, cap 11 will fit snugly around the jack plug to help prevent entry of dust.

When element 30 is snapped into a back plate by posts 21, 22, note further that the back plate itself will also tend to keep the first and second flaps in place. When modular assembly 30 is removed, dust cover 10 may be moved aside quickly if jack 20 needs replacement or service.

What is claimed is:

1. Apparatus comprising:

(a) a connector having a first side and a second side opposing the first side, the first side having a first opening therein; and, (b) a unitary cover for the connector, comprising:

(i) a cap placed on the connector first side, the cap having a hole therein in communication with the first opening; and, (ii) first and second flaps mounted on the cap, the first flap having at least one perforation, the first and second flaps each covering a portion of the connector second side.

2. Apparatus comprising:

(a) a connector comprising a first side having a first opening therein, and a second side opposing the first side, the second side having two posts mounted thereon; and, (b) a unitary cover for the connector, comprising:

(i) a cap placed on the connector first side, the cap having a hole therein in communication with the first opening; and, (ii) first and second flaps mounted on the cap, the first flap having at least one perforation, the first and second flaps each covering a portion of the connector second side, at least one flap being between the posts.

3. Apparatus as recited in claim 2, the flap between the posts having indentations, each indentation abutting a post.

4. Apparatus as recited in claim 3 wherein the connector is a jack.

5. Apparatus as recited in claim 4, further comprising a wire extending from the connector second side through a perforation in the first flap.

6. Apparatus as recited in claim 5, wherein the connector second side has a second opening into which a portion of the second flap may be inserted.

* * * * *